United States Patent [19]

Meyer et al.

[11] Patent Number: 4,947,877

[45] Date of Patent: Aug. 14, 1990

[54] HAIR REPLACEMENT METHOD

[76] Inventors: Seymour Meyer, 495 E. Shore Rd., New York, N.Y. 11024; Harvey J. Russo, 315 E. 65th St., New York, N.Y. 10021

[21] Appl. No.: 308,490

[22] Filed: Feb. 10, 1989

[51] Int. Cl.[5] ..... A41G 3/00

[52] U.S. Cl. ..... 132/201; 132/53; 132/200

[58] Field of Search ..... 132/200, 201, 202, 209, 132/53, 56; 434/94; 604/289, 290; 128/206.25; 606/131, 133, 134

[56] References Cited

U.S. PATENT DOCUMENTS

| | | | |
|---|---|---|---|
| 2,907,334 | 10/1959 | Le Mole | 132/201 |
| 3,295,534 | 1/1967 | Dorkin | 132/201 |
| 3,896,821 | 7/1975 | Clark | 132/201 |
| 4,176,669 | 12/1979 | Levin | 132/53 |
| 4,214,033 | 7/1980 | Clifton et al. | 132/53 |
| 4,254,784 | 3/1981 | Nelson | 132/53 |
| 4,688,584 | 8/1987 | Nilsen | 132/53 |

FOREIGN PATENT DOCUMENTS

| | | | |
|---|---|---|---|
| 1411241 | 10/1975 | United Kingdom | 132/201 |

OTHER PUBLICATIONS

DOW CORNING, Corning 360 Solvent.
Data Regarding DC 355 Solvent.

*Primary Examiner*—John J. Wilson
*Assistant Examiner*—Frank A. LaViola, Jr.
*Attorney, Agent, or Firm*—Wolder, Gross & Bondell

[57] ABSTRACT

A method of securing hair to patches of skin which includes applying a film of medical adhesive and before it dries to press the ends of the hair into the film. Applying a second sealing film of medical adhesive and allowing it to dry. Applying a layer of Flexible Collodion.

7 Claims, No Drawings

HAIR REPLACEMENT METHOD

FIELD OF THE INVENTION

This invention relates to a process for covering bare or sparsely covered areas of the skin with hair and more particularly to methods for directly adhering hair to the skin for extended periods of time giving the natural appearance of real hair growing out of the skin.

BACKGROUND OF THE INVENTION

Loss of hair of varying degrees from receding hair lines through varying stages of alopecia, male baldness, to complete absence of hair, has been the subject of many essays, studies, economic surveys and is the basis of an industry with sales in the hundreds of millions of dollars. The expenditures are for a whole spectrum of products ranging from nostrums to scientifically proven alleviating formulations; to topical use, through various skin covers, ranging from full wigs to hairpieces, false beards, toupees, etc.

Not all the applications of hair to non-hirsute areas has to do with hair loss. Actors and others who need to alter their appearance, also often resort to wigs and false beards, but most of applied hair is used to hide the loss thereof.

Male baldness is a physiological phenomenon, but has over the ages becomes a sociological condition. In ancient Egypt, royalty was required to exhibit full headdress. Any normal hair was supplemented with elaborate wigs. By contrast to royalty, the religious caste was required to be hairless. The latter, if not natural, was simulated by singeing.

Later, the art of wigmaking was perfected to a high degree in France and England where elaborate wigs again were social symbols of aristocracy. Some vestiges of these status wigs remain in the legal systems of England and, until recently, of France and Italy.

However, the most pressing sociological and psychological needs for supplemental hair is to be found among men who suffer from varying degrees of hair loss ranging from receding hair lines, bald spots, male baldness, to total baldness. Except for the last-named condition, which usually results from a febrile illness, these conditions are hereditary and are medically normal. However, there is an equation of hair loss with aging and, in the present youth-oriented environment, such conditions are perceived as a social shortcoming.

Wigs and hair-pieces have the hair woven into supporting and suitably shaped matrices and woven caps in the case of wigs, and appropriately-shaped nets for hair pieces. These are either fitted to the head and/or tied or woven into the existing hair. Wigs and fitted hair pieces easily loosen and the edges thereof are too often apparent. When these are fastened to existing hair, they must be repeatedly tightened, as the existing hair grows from the scalp. To overcome these problems, various adhesive tapes or gums have been used to either adhere the woven pieces to the skin or to adhere swatches of hair to the skin.

Glues give the best securement, but have several shortcomings. Most glues are irritating and at best have only short adherence spans to the normally exfoliative skin tissue. Glues and tapes have to be removed and renewed every two or three days. In general, glues are defeated by water, thus restricting showering and shampooing.

Other adhesives, such as the spirit gum (used by actors) are basded on rubber cements and are very irritating to the skin. In addition, these glues discolor and turn brown within short periods of time, even within the short span of 2–3 days, and these adhesives frequently have to be renewed.

Recently, considerable research has been instituted to improve upon and to replace present methods for hair enhancements or replacement. There are varying degrees of hair loss, including thinning and receding hair lines with various degrees of hair loss, and "bald spots" at the top or in the back of the scalp.

Among those men who require total or extensive coverage with a wig or hairpieces, many experience shortcomings with present techniques such as frequent removal, daily or at least every two or three days and renewal or re-application of fresh glue or tapes. In addition, many types of hair pieces require minimal exposure to water or high humidity. This restricts showering and often even hot baths.

Other problems with current methods include the gradual replacement of hair, increasing at interval in order that a total radical change of appearance is to be avoided. A major problem with current methods of total wigs and hair pieces is the difficulty and embarrassment of a bald person suddenly appearing with a full head of hair. This radical change in appearance could be prevented or alleviated by a method of gradually increasing naturally looking hair replacement over a period of time. Such a gradual procedure would not cause comments in social or business settings. Gradual replacement would give the appearance of normal growth, rather than the radical change of a wig. In addition, problems arise from application of small amounts of hair when and where needed as in the appearance of growth of beards and other hirsute facial adornment for long-time appearance changes as required by actors in long-running plays.

BRIEF DESCRIPTION OF THE INVENTION

It is an object of this invention to provide a method of adhering hair directly to the skin for relatively long periods of time with minimal visual indication of adhesives or hair addition and which can be applied individually or in bunches.

It is a further object of this invention to provide a method including an adhesive to use for direct application to the skin that is capable of adhering hairs, individually or in bunches or hairpieces to desired sparce areas for filling and imparting the density and appearance of natural hair.

It is also a further object of this invention to provide a method that includes the application of adhesives that are non-irritating to the skin to which the hair is applied and which will not discolor between servicing periods.

These and other objects which will become apparent, are attained by the process of this invention which comprises the steps of applying a film of a medical adhesive to patches in areas of the skin where hair is to be added. Before this film has set, the ends of the hair, in desired amounts, are pressed or embedded into the film. The film is then dried and a second sealing film of this medical adhesive is applied to the ends of the pressed and embedded hair and is air-cured by drying.

After drying, the second medical adhesive film is sealed with a layer of Flexible Collodion (NF). This completes the treatment of the single patch in the area to be covered with hair. Adjacent patches are similarly coated, the hair embedded, recoated and sealed until the bare and sparse areas are covered with hair to the desired density and fullness.

In order to clarify the invention in all its aspects, the following definitions are provided for the various terms used therein. It is understood where specific examples are provided for the general terms, that all generic equivalents are intended.

The term "medical adhesive", as mentioned above, is a silicon-based, film-forming, pressure-sensitive, adhesive (marketed by Dow Corning Corp, Midland, Michingan, USA) under the trade name Dow Corning 355 Medical Adhesive) wherein the silicone component is the silicone resin originally designated as a Silastic ®. The resin is dissoved in a vehicle-solvent, polydimethylsiloxane (Dimethicone NF XVI). The solids content is about 18.5%. Upon evaporation of the solvent, a pressure-sensitive adhesive film is formed. The adhesive film is pressure-sensitive and is sufficiently plastic to flow around the hair fibers that are pressed into it, thus adhering the hair to the film.

The adhesive cures by evaporation of the solvent. The rate of cure is dependent upon the thickness of the adhesive film and the temperature of the air used to "dry" the film. Each film of adhesive applied should have a thickness of at least 0.020Δ (0.50 mm).

The film-forming adhesive available as the above-described solution is also marketed as an aerosol spray using a fluocarbon propellent. But the liquid is preferred as it may be applied to the skin by brushing to the specific locales defining the patch where each bath of hair is to be applied, and it does not form bubbles. The spray form may also be used if the area is suitably masked. If brushes, or other applicators, are used for application of the medical adhesive, they may be cleaned in acetone. The film may be removed by the silane solvent marketed as Dow Corning 360 Medical Fluid and generically known as Dimethicone (NF).

The adhesives designated as Medical Adhesive 355 is pressure-sensitive and is preferred for use as they are sufficiently purified for application to the skin without irritation. Of course, as with all material applied to the skin for extended periods, the individual subject should be tested for sensitivity.

The term "hair", as used herein, refers to fibers that include human hair, animal hair of sufficient length and texture, and any of the synthetic substitute fibers that simulate human hair.

Among such synthetic fibers are the various nylons which accept dyes similar to human colors. Also polyester and polyolefin may be used. The fibers may be dyes in appropriate colors and accumulated into swatches of lengths sufficient for covering each of the sparse or bare subdivided areas or patches of the bare or sparse areas. Swatches should contain fibers of the desired length and swatch should include sufficient fibers to simulate the density of full growth.

The patches are subdivided areas of bare skin or skin sparsely covered with hair. The areas are typically about half-inch by quarter-inch, but may vary iron half to twice each dimension, i.e. from about 1/16 to 1 inch.

The medical adhesive should be applied directly to the cleansed skin. Preferably, the skin should be well cleansed by shampooing with a good surfactant shampoo to remove any skin oils or fats which may interfere with the curing of the adhesive.

Because of the excellent penetration of the solvent vehicle "Dimethicone" through the skin, any residual oils may be transported through the skin and cause systemic symptoms. The shampooing of the skin preferably should be followed by swabbing with a lower alkanol such as ethanol or isopropanol. The skin should then be dried at low temperature and is then ready for application of the adhesive.

Since the medical adhesive films are pressure-sensitive, the hair filaments or fibers in the swatches should be pressed into the films. Suitable pressure for embedding the fibers can be applied by running the end of an applicator stick or tongue depressor across the ends of the hair fibers in contact with the adhesive film. Examination of the interface between the hair and the film shows that after such pressure from the applicator stick, the tacky film flows around the hair fibers to effectively embed the hair in the adhesive film. The first film cures sufficiently within two to three minutes to hold the hair in place. The second film usually cures sufficiently with a similar time period, but it may be extended.

It has been noted that the adhesive films have a tendency to discolor, retain their tacky feel, and upon exposure to moisture, lose their adhesiveness during the next several days. Particularly in areas adjacent to embedded hair fibers, there is a tendency for browning of the adhesive films and the hair. Such discoloration makes the films of adhesive obvious to careful or critical observers.

To avoid such discoloration, tacky feel and loss of adhesiveness, it has been found that if after initiation of drying of the second application of adhesive film, i.e., two to three minutes, the exposure to moisture of the adhesive film is prevented by the application of a film of Flexible Collodion. A brush or other type of an applicator may be used in a similar fashion to the application of the adhesive films. The commercial collodion solutions serve adequately, but "Flexible Collodion" or "Court Plaster" as is used for medical purposes, is preferred as being plasticized and thus provided better adherence and is less prone to peeling. The castor oil plasticizer does not readily migrate through the silicone adhesive layers as to cause any problems of sensitization of the underlying skin.

On normal healthy skin, the combination of the adhesives and the Flexible Collodion hold the hair for at least two to four weeks, after which the normal exfoliation starts loosening of the adhesive. Within this time period, the adhesive holds the hair in place and is sufficiently impervious to water so that the areas may be shampood daily. Furthermore, discoloration and the tacky feel is eliminated. It feels like a person's scalp.

During this period of adherence, the treated areas should be regularly inspected, loose hairs replaced or re-adhered, and the applied hair shampooed and styled consistent with normal growth in adjacent areas where the natural hair is growing.

The fibers of hair of proper length are selected and are aligned so that the ends are substantially even. The number of hair fibers are approximated to fill in the sparse area. They are pressed into flat aligned layers between the thumb and forefinger in amounts approximating the density desired or matching to the adjacent hair. The swatches are then applied to the first film in the patch to be covered.

EXAMPLES OF THE METHOD

1. Preparation of the Scalp for Receivng the Hair (a) Shampoo the entire scalp and existing hair with soap shampoo.

(b) Dry hair and scalp thoroughly with towel and low-heat dryer.

(c) Gently swab scalp with rubbing alcohol (ethanol or isopropanol-based) and allow to dry after patting with tissues. Low-heat dryers may be used.

2. Application of Hair to the Scalp (a) To a patch in the balding area, approximately ½' by ¼", apply the medical adhesive (Medical Adhesive 355 Dow). This is a solution of silicone resin 18% W/V in the solvent. A soft brush is used as the applicator to form a thin film at the area about 0.50 mm thick. Afer application, dry the film to a tacky finish.

(b) Take a small tuft of hair and spread it between the thumb and forefinger or middle finger to form a fanned bunch about ½" wide at the base. Apply this base end of the tuft to the tacky film on the scalp and press into the film with an edge of an applicator stick. The pressure is applied against the scalp through the film, thus embedding the hair tuft in the adhesive film. Allow the film and embedded hair to dry for about two minutes.

(c) Apply a second coat of the medical adhesive to the patch where the hair is embedded. This second coating film is about the same thickness as the first film. The second coat dries in about 3 minutes.

(d) Apply a cool hair-dryer stream to the area to speed the drying process.

(e) The area of the dried film is then coated with a thin film of Flexible Collodion (NF). This film thickness should be sufficient to seal the surface of the medical adhesive in the areas where the hair is embedded.

(f) Repeat steps (a) to (e) for adjacent areas with additional tufts of hair and repeat until the bald or sparse areas are adequately covered.

(g) The hair is then cut and styled to match the existing hair.

Note to Technician: The medical adhesive and films thereof may be removed with acetone from the brushes and any undesired areas of accidental contact. If coated on undesired portions of the skins, it may be similarly removed.

Instructions to the client:

(1) Shampoo hair about two times a week. Use a big, soft sponge, preferably a soft natural sponge to soak the hair.

(2) Shower as often as desired.

(3) To dry hair, compress with a towel or use a hair-dryer. *Do not* rub vigorously with the towel.

(4) To set hair, use a soft bristle brush.

(5) Come in for re-application after 3 or 4 weeks, but sooner if hair loss begins.

We claim:

1. A process for converting, with hair, bare or sparse areas of the skin which, after cleansing and preparing said areas, comprises the steps of:

(a) applying to a patch in said bare or sparse area, a film-forming solution of a pressure-sensitive silicone-based medical adhesive to form a coating on said patch;

(b) adhering a swatch of hair fibers to the resulting film patch by pressure embedding and adhering said fibers;

(c) drying the film patch with said adhered hair;

(d) applying a second coat of said adhesive at the patch areas where said hair is adhered forming surfaces;

(e) drying said second coat with an air stream;

(f) coating the surfaces of the hairy patches of adhesive with collodion and drying said surfaces to seal same with collodion; and (g) repeating said applying, drying and coating steps (a)–(f) in adjacent bare or sparse patches until the skin areas are covered with hair to a desired density and fullness.

2. The process according to claim 1, wherein said patches are each about 1/16 inch by ½ inch.

3. The process according to claim 1, wherein said patches are each about ¼ inch by 1 inch.

4. The process according to claim 1, wherein said hair fibers are selected from the group consisting of natural hair fibers, fur fibers and synthetic hair fibers and mixtures thereof.

5. The process according to claim 4, wherein said fibers are pre-dyed to simulate and match existing hair color.

6. The process according to claim 1, wherein the swatches contain an amount of fibers sufficient to simulate a desired hair concentration and density.

7. The process according to claim 6, wherein the fibers in said swatches should be applied at a density of at least 100 fibers/inch$^2$.

* * * * *